United States Patent [19]

Yokoi

[11] Patent Number: 4,822,191

[45] Date of Patent: Apr. 18, 1989

[54] GUIDE BLOCK FOR A PRINTER FOR GUIDING CONTINUOUS PAPER

[75] Inventor: Takeshi Yokoi, Nagoya, Japan

[73] Assignee: Brother Kogyo Kabushiki Kaisha, Nagoya, Japan

[21] Appl. No.: 112,194

[22] Filed: Oct. 21, 1987

Related U.S. Application Data

[62] Division of Ser. No. 799,753, Nov. 19, 1985, abandoned.

[30] Foreign Application Priority Data

| | | | |
|---|---|---|---|
| Nov. 20, 1984 | [JP] | Japan | 59-175818 |
| Feb. 5, 1985 | [JP] | Japan | 60-14887 |
| May 2, 1985 | [JP] | Japan | 60-66064 |

[51] Int. Cl.[4] ..... B41J 11/32

[52] U.S. Cl. ..... 400/616.1; 400/613.3; 226/79

[58] Field of Search ..... 400/611, 613, 613.2, 400/613.3, 616, 616.1, 616.2, 616.3, 692; 226/74, 75, 76, 77, 79

[56] References Cited

U.S. PATENT DOCUMENTS

| | | | |
|---|---|---|---|
| 3,420,352 | 1/1969 | Moran et al. | 400/616 |
| 3,549,068 | 12/1970 | Calano | 400/616.3 |
| 4,115,014 | 9/1978 | Wood et al. | 400/616.2 |
| 4,344,715 | 8/1982 | Van Horne et al. | 400/616.1 |
| 4,345,708 | 8/1982 | Hubbard | 226/74 |
| 4,400,105 | 8/1983 | Yeager et al. | 400/692 |
| 4,500,023 | 2/1985 | Akazawa | 226/76 |
| 4,501,510 | 2/1985 | Andersson | 400/616.3 |
| 4,571,103 | 2/1986 | Takeo et al. | 400/616.1 |
| 4,643,603 | 2/1987 | Hauslaib | 400/616.1 |

*Primary Examiner*—David A. Wiecking

*Attorney, Agent, or Firm*—Jordan and Hamburg

[57] ABSTRACT

A printer for printing characters through a printing ribbon on printing paper placed on a platen by moving a carriage along the platen and driving a printing head on the carriage. The platen is placed in the rear end portion of the printer frame. An opening for insertion of printing paper is formed in the rear end surface of the frame to which the platen is approximated. A feeder for feeding continuous printing paper is provided for connection to this opening. The feeder includes a pair of laterally adjustable feed guide blocks each having a sprocket wheel. These blocks are essentially hollow and have interior reinforcing plates and an open bottom.

8 Claims, 12 Drawing Sheets

24
63
136
118
115
120
116
131
119
133
132
128
64
65
111
1
138
C
137
139
139a
134
141
140
142
130
P
135
117
125
127
126
129
110
34
35
62
47
44
10

GUIDE BLOCK FOR A PRINTER FOR GUIDING CONTINUOUS PAPER

This is a division, of application Ser. No. 799,753, filed Nov. 19, 1985, now abandoned and refiled as 122,524 on 11/18/89.

BACKGROUND OF THE INVENTION

1. Field of the Invention

The present invention relates to a printer, more particularly to a printer which is arranged to be used with a paper feeder connected to the printer at the rear thereof, which is, for example, an apparatus for feeding single sheets of paper such as post cards one after another to a platen by means of rotation of a roller, and an apparatus for feeding, by means of sprocket wheels, a continuous length of printing paper having along its side edges a plurality of successive perforations.

2. Description of the Prior Art

Among conventional printers, one known type is arranged such that it is provided with: a platen in the middle of a frame; a carriage having a printing head, placed in front of the platen and adapted for moving along the platen; motors for driving the platen, the carriage, etc.; and a controller for driving these motors, these motors, the controller and other parts being located at the rear of the platen.

The rear end of this conventional printer is closed due to the location of the controller, etc. Single sheets or a continuous length of printing paper is necessarily fed from the upper side of the platen, led therearound and inserted into the area between the platen and the printing head. When a sheet of printing paper which is different from the kind proper to a paper feeder connected to the printer frame needs to be manually inserted, the paper feeder must be replaced. This is laborious for an operation in printing on a sheet of printing paper alone.

On one hand, when the printing paper is fed from the upper side of the platen, along the outer circumference of the platen and to the upper forward hand of the same, the printing paper is curved by 180 degrees or more. Then, the printing paper, especially in case of post cards, stays in a considerably curved shape so that it becomes hard to deal with.

The continuous length of printing paper in the form of folded layers having perforations along its side edges is placed to the rear of the printer frame or under a table on which the printer frame is mounted. Such paper has to be led above the level of the platen and then downwardly led to the platen, according to the conventional way of insertion in which the paper fed from the upper side of the platen. As a result, a guide path of the printing paper is elongated, and the whole size of the paper feeder is disadvantageously enlarged.

The conventional printer is provided with a concave guide member which faces the platen and covers over the rear side and underside of the platen. The guide member has a paper feed roller which pressingly contacts the underside of the platen. However, this roller contacts the platen by a pressing force adapted for feeding thin and pliable paper which is most commonly used. In case of printing on a sheet of printing paper such as a post card which is thick and having high stiffness, the printing paper is outwardly stretched by virtue of its stiffness and pressingly contacts the concave guide member such that the pressing force of the roller is not enough to feed the printing paper without any retard from the rotation of the platen. Thus, the sure feeding operation has not been performed.

An ordinary paper feeder for supplying a continuous printing paper has a pair of sprocket wheels for feeding a continuous printing paper to a inlet opening of the printer. When the sprocket wheels are respectively disposed in largely distanced positions, corresponding to the breadth of the continuous printing paper, this paper sometimes lowers by its weight between the sprocket wheels. In this case, the front edge of the continuous printing paper contacts the edge of the inlet opening of the printer when the paper is fed, so that the feeding mechanism does not function well. When the front edge of the continuous printing paper floats up, being fed outwards from the sprocket wheels, it sometimes hits on the outer surface of the printer frame, thus obstructing its loading.

SUMMARY OF THE INVENTION

The main object of the present invention is to provide a printer which can be fed with printing paper by inserting this paper from the rear side of the printer as well as from the upper side of the same, that is, into which the paper can be inserted from the upper side of the printer even when a paper feeder for a different type of printing paper is installed to the printer frame. Another object of the present invention is to provide a printer which does not cause considerable curvature in a sheet of thick printing paper such as a post card and is provided with a short guide path of the printing paper in a paper feeder for feeding a continuous printing paper, so as to be reduced in entire size.

Still another object of the present invention is to provide a printer with a paper feeder for securely feeding a sheet of thick printing paper such as a post card without any slippage.

A further object of the present invention is to provide a printer with a paper feeder for smoothly loading a continuous printing paper having wide breadth on the platen without any suspension and floating of the paper.

A still further object of the present invention is to provide a paper feeder for feeding a continuous printing paper, which has a simple construction and is easy to construct.

To these ends, the present invention provides in one of its aspects a printer comprising: a frame having an upper cover and a rear cover extending generally vertically at the rear end of the upper cover; a platen provided in the frame in close proximity with the upper cover and the rear cover and supported rotatably on an axis which is parallel with the upper and rear covers; a carriage movable along the platen in the longitudinal direction thereof, placed in the frame on one side of the platen which is opposite to the other side thereof where the rear cover is located; a printing head supported on the carriage so as to face the platen; an open area for exposing part of upper and rear surfaces of the platen, formed in a position between the upper cover and the rear cover; a paper guide member placed in the frame, facing the lower surface of the platen at a distance, the rear edge of the paper guide member being connected to the rear cover at the lower edge of the open area, whereby a printing paper is capable of being inserted in the direction to the platen from one portion of the open area formed in the upper cover as well as from the other portion of the open area formed in the rear cover.

The present invention provides in another of its aspects a printer comprising: a printer frame; a platen rotatably supported at the rear end portion of the printer frame; an open area for insertion of printing paper formed in the rear end surface of the printer frame in a position adjacent to the platen; a support member movably supported on the printer frame in the vicinity of the open area and having an engagement portion exposed at the outer surface of the printer frame; a paper feed roller rotatably supported by the support member and being movable with movement of the support member between an operative position at which the paper feed roller engages with the platen so as to guide and feed printing paper, and an inoperative position at which the paper feed roller is detached from the platen; a feeder detachably installed to the printer frame in a position opposed to the support member and adapted for feeding stacked sheets of printing paper one after another through the open area to an area between the platen and the paper feed roller; a holding member provided in the feeder and adapted to engage, when the feeder is installed to the printer frame, with the engagement portion of the support member and move the support member so as to hold the paper feed roller in the operative position; and the support member being moved, when said feeder is detached from the printer frame, so as to hold the paper feed roller in the inoperative position.

The present invention further provides in another of its aspects a printer comprising: a printer frame; a platen having a circular cross-section and rotatably supported in the rear end portion of the printer frame; a paper guide member provided in the p inter frame in the vicinity of the platen and having a concave arc surface facing the platen at a predetermined distance; an open area formed in the rear end surface of the printer frame in a position adjacent to said platen; a feeder having a frame with a forward side having an opening and detachable installed to the printer frame, so as to feed with a continuous printing paper, having a plurality of perforations formed along both side edges thereof, from the opening of the frame to the platen through the open area of the printer frame, the feeder having: a pair of sprocket wheels each having a plurality of pins engaging with perforations of the continuous printing paper, and supported rotatably on an the axis which is parallel with the platen; a first guide block having a first and a second guide surfaces which face one surface of the continuous printing paper between the sprocket wheels, the first guide surface being formed substantially along part of the outer circumference of the sprocket wheels, and the second guide surface extending from the first guide surface toward the concave arc surface of the paper guide member; and a second guide block having a guide surface which faces the other surface of the continuous printing paper, one end of the second guide block extending through the open area substantially parallel with the concave arc surface of the paper guide member, whereby the front end of the continuous printing paper transfered from the feeder towards the platen by means of the sprocket wheels is introduced into an area between the platen and the paper guide member, the front end of the continuous printing paper being prevented from floatation of the continuous printing paper by means of the second guide block of the feeder. The present invention further provides in another of its aspects a printer comprising: a printer frame; a platen having a circular cross-section and rotatably supported in the rear end portion of the printer frame; an open area formed in the rear end surface of the printer frame in a position adjacent to the platen; and a feeder having a frame in the front of a box with its forward, rear and upper sides having openings respectively, the frame being detachably installed to the printer frame, so as to feed with a continuous printing paper, having a plurality of perforations formed along both side edges thereof, from the forward side opening of the frame to the platen through the open area of the printer frame, the feeder having: a rotating shaft mounted in the frame and being parallel with each of the openings; a pair of guide blocks provided in the frame and being slidable in the axial direction of the rotating shaft; and a pair of sprocket wheels respectively disposed in the guide blocks and partially projecting from the upper surface of the corresponding guide blocks, the sprocket wheels being unitedly rotatable with the rotating shaft and slidable in the axial direction of the shaft, wherein: the pair of guide blocks are formed into boxes opened toward the bottom surface of the box-shaped frame, each of which includes: an upper wall plate having the upper surface partially curved generally along part of outer circumference of the sprocket wheel and a pair of left and right side wall plates having hole through which the rotating shaft is penetrated, the left and right side wall plates of the pair of guide blocks being opposingly located along the axial direction of the rotating shaft; each of the guide blocks includes: a slit formed in the upper wall plate and connected with a space for accommodating the sprocket wheel in the guide block is exposed; and downwardly opened channels respectively formed in a pair of walls located on opposite sides of a space for accommodating the sprocket wheel formed downwardly and continuously from the slit; and each of the sprocket wheels includes a boss sleeve portion fitted to the rotating shaft and extending the axial direction thereof, and the opposite ends of the boss sleeve portions of the pair of sprocket wheels are respectively opposed to the inner sides of the left and right side wall plates of the pair of guide blocks when the boss sleeve portions are inserted into the channels, the part of the circumference of said sprocket wheel is exposed through the slit.

The present invention further provides in another of its aspects a printer comprising: a printer frame; a platen having a circular cross-section and rotatably provided in the printer frame; a printing head provided in the printer frame so as to face the platen; a printing paper path having at one end thereof an open area for insertion of a continuous printing paper, which is opened in the outer surface of the printer frame, for the purpose of feeding the continuous length of printing paper to the area between the printing head and the platen; a first gear rotatable in a linked relation with rotation of the platen, at least part of the outer circumference of the gear being exposed in the outer surface of the outside of the printer frame; and a feeder for feeding the continuous printing paper to the platex along the printing paper path, the feeder being detachable installed to the printer frame, the feeder having: a frame in the form of a box with at least its forward and rear sides opened, having a pair of left and right side walls in which aligned bearing holes are respectively formed, the forward side of the frame facing the open area; a rotating shaft rotatably supported by the bearing holes and spanned between the side walls; a pair of sprocket wheels each having a plurality of pins engaging with perforations formed along both side edges of the continuous printing paper, and fitted on the rotating shaft, between the side walls; a second gear adapted for engaging with the first gear and fixingly connected to one end of the rotating shaft projecting through corresponding one of the side walls to the outside of the box-shaped frame; and a side cover for covering the latter gear, attached to the one side wall of the left and right side walls, the side cover contacting the one end of the rotating shaft so as to prevent movement of the rotating shaft in its axial direction from the one side wall toward the outside of the box-shaped frame.

BRIEF DESCRIPTION OF THE DRAWING

FIG. 1 is a perspective illustration of a printer;

FIG. 2 is a plan view showing the right side portion of the printer with its opened upper cover surface;

FIG. 3 is a longitudinal sectional view of the printer with assembled parts;

FIG. 4 is a perspective exploded view showing a printing mechanism of the printer;

FIG. 5 is a perspective exploded view showing a main frame and a sub-frame of the printer;

FIG. 6 is a plane view showing the whole of the printer.

FIG. 7 is a partial longitudinal sectional view showing the printer combined with a post card feeder;

FIG. 8 is a partial plan view showing the rear end of the printer provided with paper feed roller;

FIG. 9 is a partial sectional view showing the paper feed roller disposed in the inoperative position.

FIG. 10 is a perspective view showing the printer and a continuous paper feeder which are detached from each other;

FIG. 11 is a schematic side view showing the constitution of a driving mechanism including a platen of the printer and a sprocket wheel of the continuous paper feeder;

FIG. 12 is a longitudinal sectional view of the continuous paper feeder;

FIG. 13 is a cross-sectional view taken along the line 13—13 of FIG. 12, showing the printer combined with the continuous paper feeder;

FIG. 14 is a cross-sectional view taken along the line 14—14 of FIG. 12;

FIG. 15 is a cross-sectional view taken along the line 15—15 of FIG. 12;

FIG. 16 is a cross-sectional view taken along the line 16—16 of FIG. 12;

FIG. 17 is a cross-sectional view taken along the line 17—17 of FIG. 12; and, FIG. 18 is a cross-sectional view taken along the line 18—18 of FIG. 12.

DETAILED DESCRIPTION OF THE PREFERRED EMBODIMENTS

First Embodiment

The first embodiment embodying the present invention will be described hereinafter in detail with reference to FIGS. 1 to 6.

Figure 1:
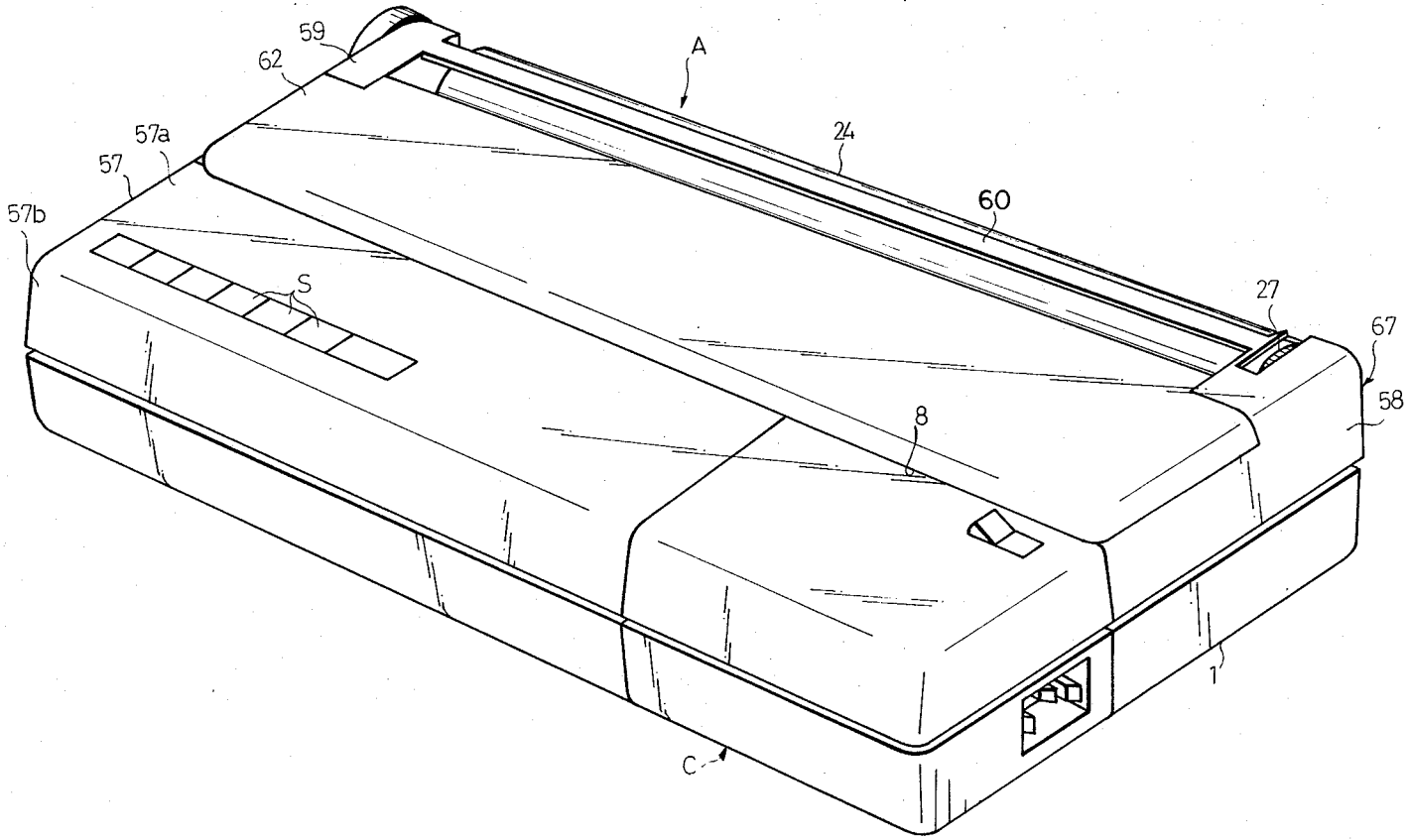
FIGS. 1 to 6 show one embodiment of the present invention.
Figure 4:
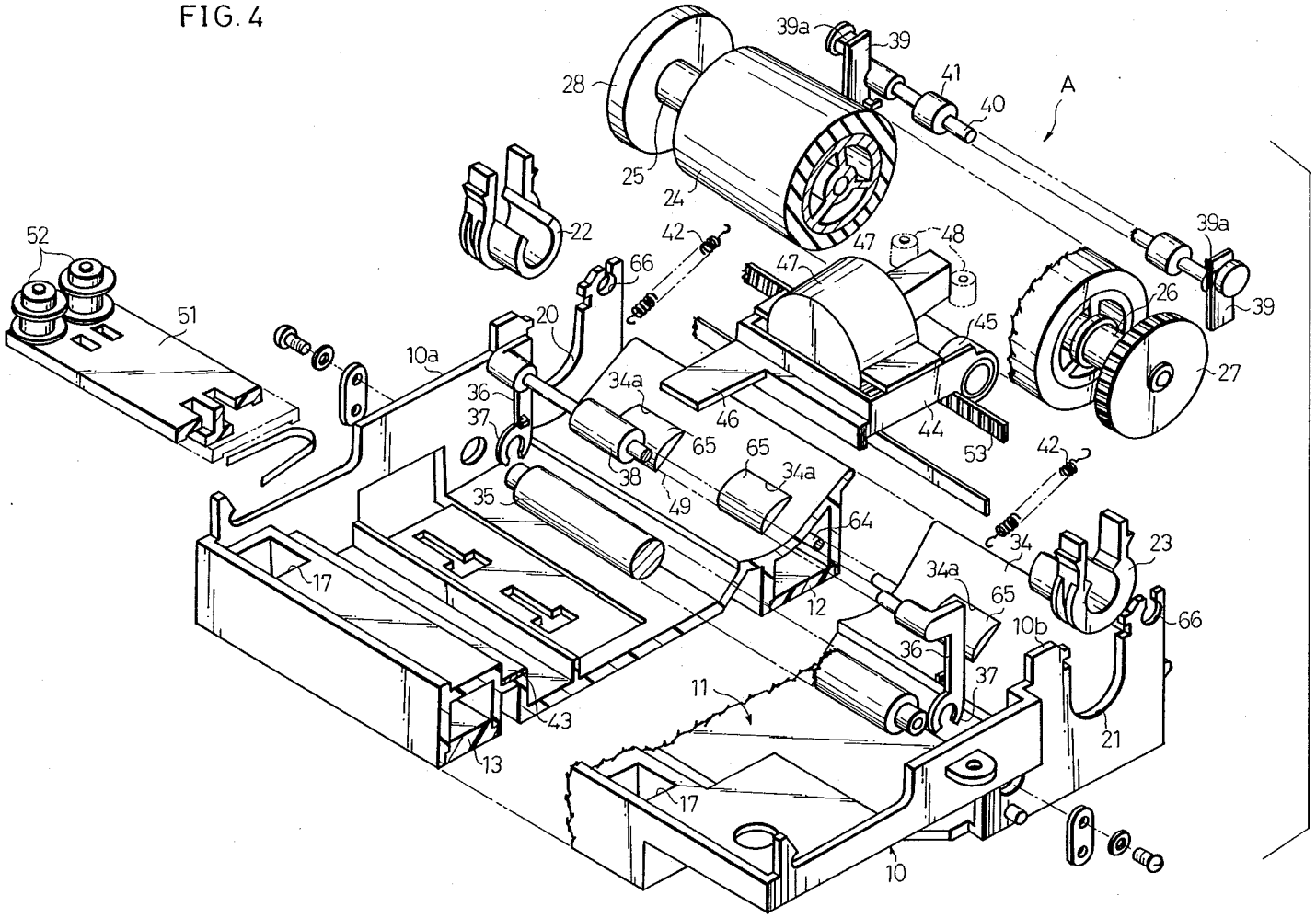
Figure 5:
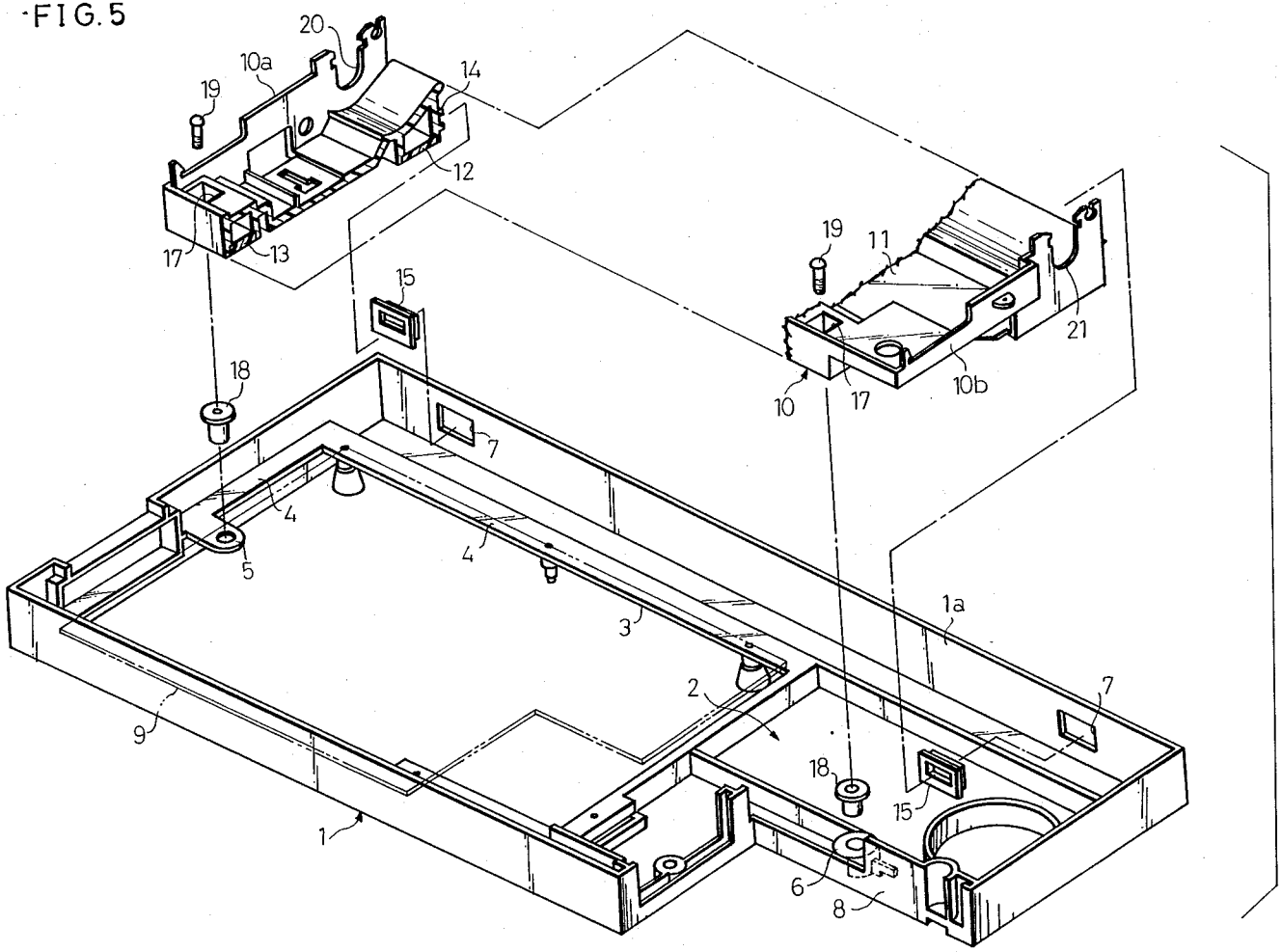

As shown in FIG. 1, a printer frame has a form of a flat, general hexahedron and is composed of, in appearance, upper cover surface, lower cover surface, front and rear cover surfaces, and left and right cover surfaces. The printer frame is composed of a main frame 1 located at the bottom of the printer frame, a cover plate 57 covering the upper left hand side of the forward portion of the main frame 1, a case C located on the right side of the cover plate 57, a sub-cover plate 62 covering the upper side of the printer at the rear of the cover plate 57 and the case C, and a rear cover member 67 covering the left and right sides of the rear portion of the printer, this portion generally corresponding to a portion covered by the subcover plate 62. Thus, these constituent members of the frame is assembled to form the hexahedron. As shown in FIG. 5, a sub-frame 10 for supporting a printing mechanism A is provided in the rear portion of the printer frame. A platen 24 extending leftwards and rightwards is placed on the rear end portion of the sub-frame 10, as shown in FIG. 4.

The main frame 1 is formed by a bottom wall, a forward side wall, a rear side wall, a left side wall and a right side wall, and is made of plastic resin material, thus integrally formed in the shape of a bottomed box, as shown in FIG. 5. The bottom wall constitutes the lower cover surface, around which lower half portions of the front and rear cover surfaces and the left and right cover surfaces are formed by the forward side wall, the rear side wall and the left and right side walls.

Figure 3:
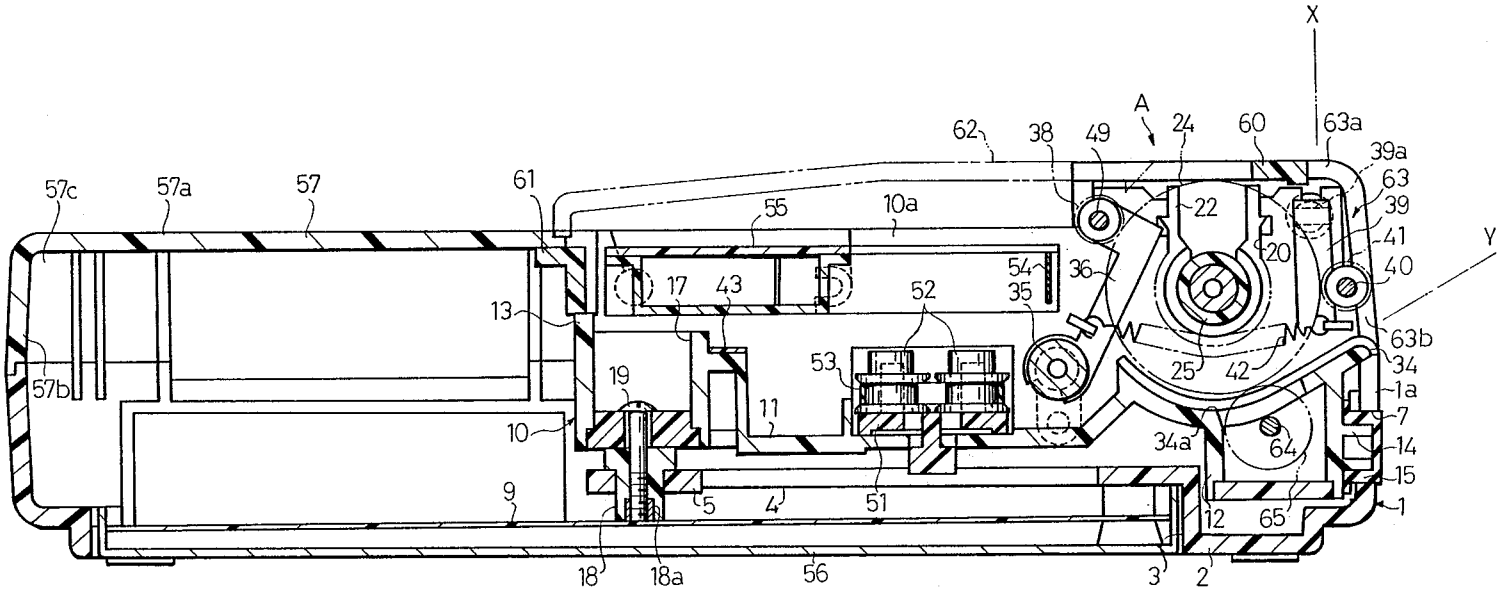

As shown in FIGS. 1 and 3, the cover plate 57 is made of plastic resin and is integrally formed by an upper wall portion **57*a* constituting the left forward hand portion of the upper cover surface of the printer frame, a front wall portion 57*b*** constituting the left hand portion of the front cover surface, and a side wall portion constituting the forward portion of the left cover surface, and is made of plastic resin.

Figure 6:
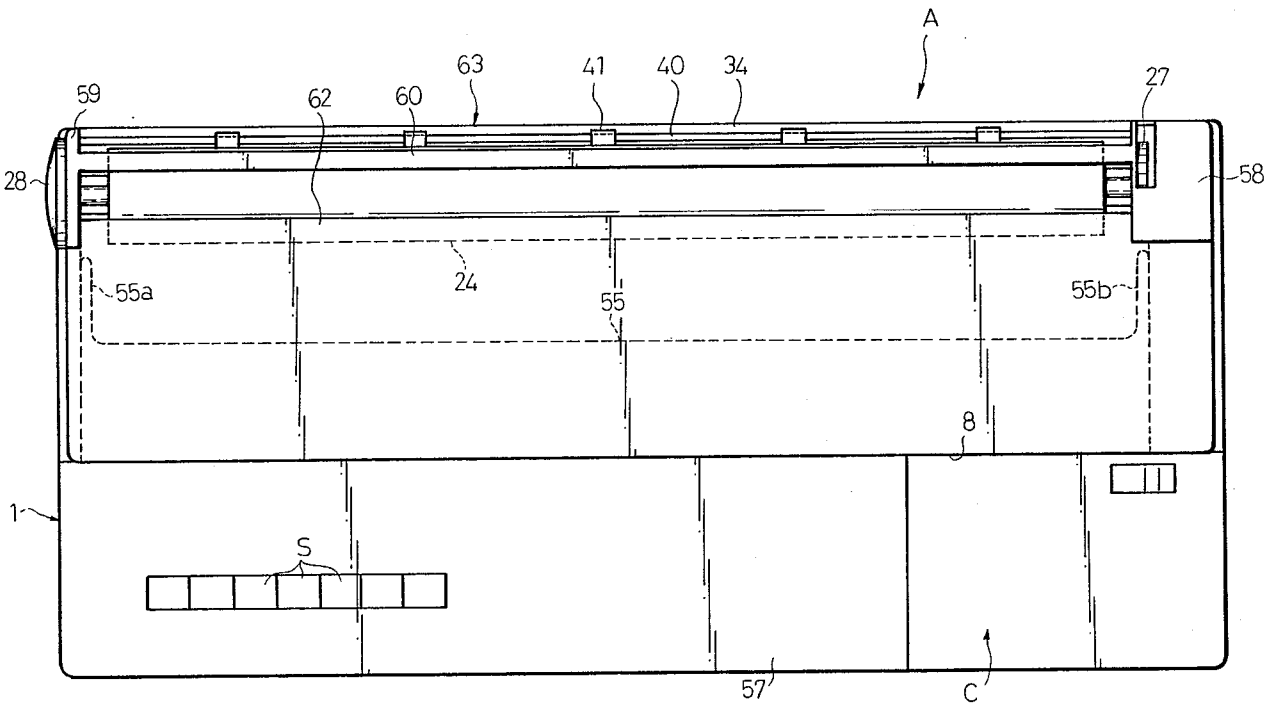

As shown in FIGS. 1 and 6, the rear cover member 67 is made of plastic resin and is integrally formed by a pair of left and right side covers 58 and 59, and a pair of front and rear connecting portions 60 and 61 for connecting these left and right side covers 58 and 59. The side covers 58 and 59 comprise horizontal portions which, together with connecting portions 60 and 61, constitute the rear portion of the upper cover surface, and also comprise vertical portions which downwardly extend from the left, side and rear edges and the right, side and rear edges of the horizontal portions and which constitute the rear portions of the left and right cover surfaces, and the left and right hand portions of the rear cover surface. The side covers 58 and 59 correspond the left and right ends of the platen 24.

A cut out portion 8 which is forwardly and rightwardly opened is provided in the forward and right hand corner of the printer frame. The case C is attached to the cut out portion 8 and is adapted for accommodating a power unit such as a transformer for supplying an electric control circuit with power.

A rectangular opening 3 is formed in the bottom portion 2 of the main frame 1, as shown in FIGS. 3 and 5. At the rear, left and right edges of this opening 3 is formed a rib 4 which rises up from the three sides of the opening 3, its upper end portion inwardly and horizontally extending. An inwardly protruding mounting projection 5 is provided on the inner edge of the rib 4 located at a position which can be seen on the left side of FIG. 5. A mounting boss 6 is formed integrally with the bottom portion 2 of the main frame 1, on the right hand side of the opening 3. In the rear wall **1*a* of the main frame 1 are disposed a pair of right and left through holes 7** which are spaced from each other by a given distance.

Next, the constitution of the printing machanism A is described. As shown in FIGS. 3, 4 and 5, the sub-frame 10 of the printing mechanism A is formed of plastic resin, into a bottomed box, as in the case of the main frame 1. Reinforcement portions 12 and 13 in the shape of rectangular tubes extending parallel with each other are formed respectively on the rearward and forward sides of the subframe 10. Each of the reinforcement portions 12 and 13 is provided with a plurality of ribs (not shown) which integrally connect the opposed, fore and rear inner walls of the reinforcement portions with each other. Torsion of the sub-frame 10 is prevented by the reinforcement portions 12 and 13.

A pair of protrusions 14 which can be loosely inserted in the through holes 7 are integrally formed on the rear side of the rear reinforcement portion 12. The outside of each protrusion 14 is covered and tightly in contact with a first cushion member 15 which is made of rubber in the shape of a cap. Each protrusion 14 and the corresponding first cushion member 15 are inserted into each through hole 7, and the outer surface of each first cushion member 15 is brought tightly into contact with the inner surface of the through hole 7. In this condition, the rear portion of the subframe 10 is fixed to the main frame 1. When in the fixed state, the first cushion member 15 lessens, between the main frame 1 and the subframe 10, the vibration occurring in the printing mechanism A, and prevents any collisional contact of the main frame 1 and a paper feeding apparatus (later described), by protruding from the rear end surface of the main frame 1.

A pair of recessions 17 respectively facing the mounting projection 5 and the boss 6 are formed about the opposed ends of the forward reinforcement portion 13. Each second cushion member 18 made of rubber in the shape of a cylinder with a flange is inserted into the through holes of the mounting projection 5 and the boss 6, from the upper side thereof. A nut 18*a* is inserted in and fixed to the lower side of a hole for insertion of a screw formed in the center of the second cushion member 18. The cushion member 18 bulges around its diameter by the action of a screw 19 which penetrates the bottom of the recession 17 and is screwed into the nut 18*a*. The outer circumference of each cushion member 18 is brought tightly into contact with the inner surfaces of the mounting projection 5 and the boss 6. In this condition, the fore portion of the sub-frame 10 is fixed to the main frame 1. Between these too, as in the above, the vibration of the printing mechanism A is lessened.

A pair of opposed bearing recesses 20 and 21 which are opened upwardly are formed on the rear portion of left and right side walls 10*a* and 10*b* of the sub-frame 10. Bearing members 22 and 23 formed by plastic resin are respectively set in the bearing recesses 20 and 21.

Between the left and right side walls 10*a* and 10*b*, on the rear portion of the main frame 1, is placed the platen 24. Shafts 25 and 26 located on the opposed ends of the platen 24 are rotatably supported by the bearing members 22 and 23. A driving gear 27 is attached to the right shaft 26. A knob 28 for rotating operation of the platen 24 is fixed to the left shaft 26.

Figure 2:
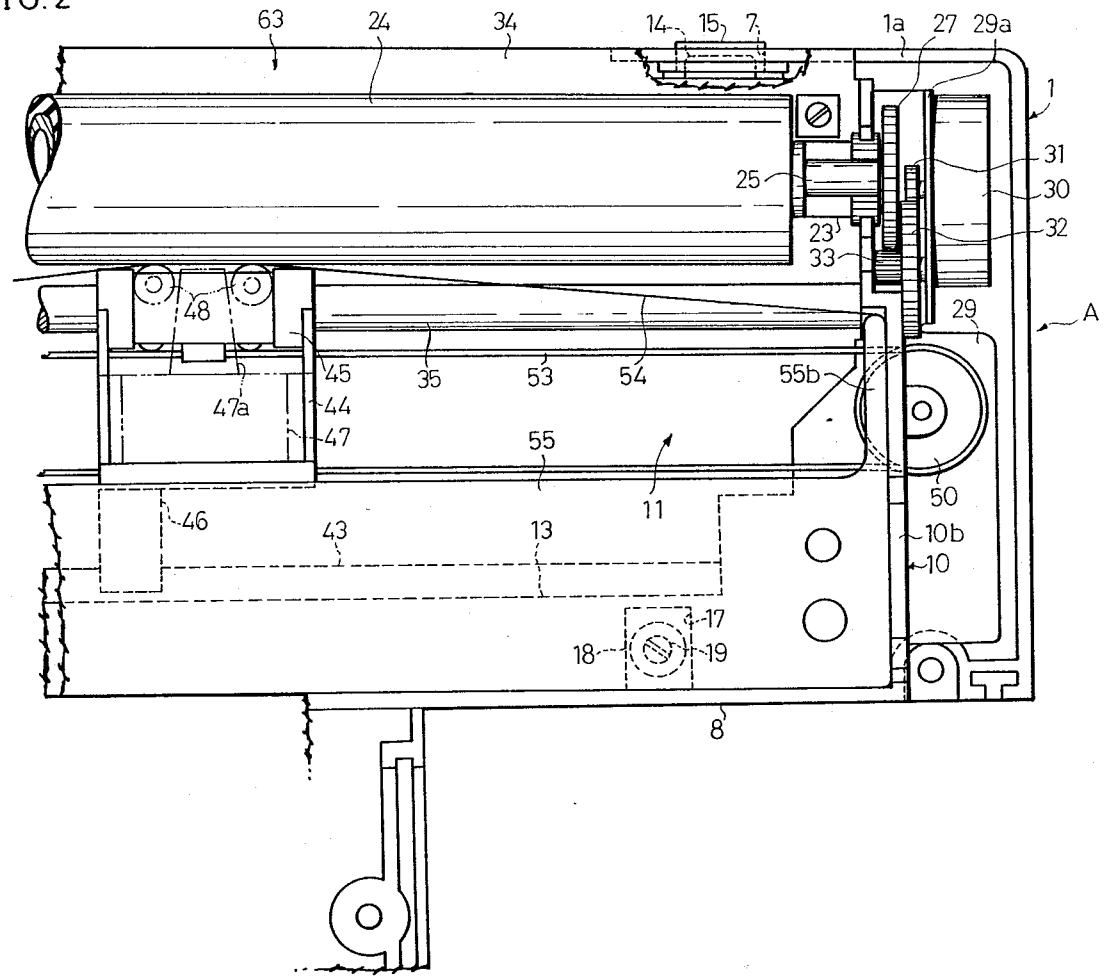

As shown in FIG. 2, a support 29 (not shown in FIG. 4) is provided between the right side wall 10*b* of the sub-frame 10 and the right side wall of the main frame and is attached to the right side wall 10*b* of the sub-frame 10. A driving motor 30 for driving the platen is mounted on a stand-up wall 29*a* which is continuously formed at the rear end of the support 29. A gear transmission mechanism comprising a plurality of gears 31 to 33 is placed between the driving motor 30 and the driving gear 27. The rotational movement of the driving motor 30 is transmitted to the platen 24 by the medium of this gear transmission mechanism and the driving gear 27.

As shown in FIGS. 2 to 4, a guide member 34 having a concave arc surface, adapted for forwardly guiding the printing paper from the rear of the platen 24 is integrally formed in the sub-frame 10, under the platen 24. A plurality of openings 34*a* are formed in this guide member 34, being spaced a given distance apart in the leftward and rightward directions. In the rear reinforcement portion 12, a supporting shaft 64 is supported by leaf springs (not shown) movably substantially in the radial direction of the platen 24. A plurality of guide rollers 65 protruding through the openings 34*a* over the upper side of the guide member 34 and engaging with the platen 24 are rotatably held by the supporting shaft 64. The guide rollers 65 are urged by the leaf springs in the direction of engagement with the platen 24. The opposite walls 10*a* and 10*b* are spanned, downwardly in front of the platen 24, with a guide rod 35 which extends approximately parallel with the platen 24. A pair of movable levers 36, the lower end portions of which form encircling holder portions 37 having substantially circular shapes for supporting purposes, is swingably supported, by the left and right end portions of the guide rod 35. The upper end portions of the movable lever 36 are spanned with a paper bail bar 49 having a plurality of paper bail rollers 38 which rotates in accordance with the rotation of the platen 24.

At the rear of the platen 24, a pair of supporting levers 39 is detachably and swingably supported, at its upper end mounting shafts 39*a*, by recesses 66 of the opposed side walls 10*a* and 10*b*. Between the opposed supporting levers, a rotating shaft 40, which has a plurality of pressing rollers 41 for pressing a single sheet of printing paper downwardly inserted about the platen 24 against the same, is rotatably supported so as to supply the platen 24 with feeding force. A point of springs 42 is stretched between the movable lever 36 and supporting lever 39 which are located on opposite sides of and interposed by the platen 24. The springs 42 urge the bail rollers 38 and the pressing rollers 41 to pressingly contact the platen 24.

The forward reinforcement portion 13 is provided with a guide portion 43 extending therealong, on the rear side thereof. The guide rod 35 fittingly penetrates a cylindrical shaft 45 formed on the rear portion of a carriage 44 so that the carriage 44 is movably supported by the guide rod 35. A guide extension 46 formed on the carriage 44 such as to forwardly protrude therefrom engages with the upper surface of the guide portion 43. On the carriage 44, a printing head 47 for printing characters having dot matrix patterns is mounted and fixed. A nose 47*a* of the printing head 47 faces the platen 24.

As shown in FIGS. 2 and 4, a pair of rollers 48 is held on the carriage 44, on each side of the nose 47*a*, so as to rotate around their own axes extending in the substantially vertical direction. The rollers 48 slightly protrude beyond the nose 47*a* at the rear thereof and contact the printing paper on the platen 24, whereby the rotational movement of the carriage 44 around the guide rod 35 is restricted.

On the upper surface of the middle portion of the support 29, a driving pulley 50 rotated by a carriage driving motor (not shown) is provided. A pair of driven pulleys 52 is rotatably held on a supporting plate 51 mounted on the left hand upper surface of the bottom wall 11 of the sub-frame 10. A toothed belt 53 is provided about the driven pulleys 52 and the driving pulley 50. A part of this belt 53 is fixed to the carriage 44. Thus, by the reversible rotation of the driving motor and by the medium of the pulleys 50 and 52 and the belt 53, the carriage 44 and the printing head 47 are reciprocatively moved leftwards and rightwards, along the platen 24.

Between the left and right side walls 10*a* and 10*b* of the sub-frame 10, in front of the platen 24, a ribbon cassette 55 having an endless ink ribbon 54 is detachably mounted. Between the guide portions 55*a* and 55*b* located at the left and right ends of the ribbon cassette 55 (refer to FIG. 6), the exposed ribbon 54 covers the whole printing area of the platen 24. The exposed portion of the ribbon 54 is positioned between a tip of the printing head 47 and the platen 24. In the period of the printing operation, as it accompanies the reciprocative movement of the carriage 44, the used ribbon 54 is fed through the right guide portion 55*b* into the cassette 55, thus retrieved, and the unused ribbon 54 is pulled out from the inside of the cassette 55 through the left guide portion 55*a*.

The printing mechanism A is constituted by the platen 24, the carriage 44, the printing head 47 and the ribbon cassette 55, etc.

As shown in FIGS. 3 and 5, a supporting plate 56 for covering the opening 3 thereunder is attached to the bottom surface of the main frame 1. Between the supporting plate 56 and the main frame 1, a printed circuit board 9 is provided, which has a central processing unit constituting an electric control circuit, and a character generator circuit, etc. As shown in FIGS. 1, 3 and 6, the cover 57 covering the fore portion of the printed circuit board 9 is detachably attached to the side walls of the main frame 1. Various types of operating switches S for inputting given signals to the electric control circuit are disposed in the cover 57.

As shown in FIG. 3, the rear connecting portion 60 of the rear cover member 67 is placed upwardly at the rear of the platen 24. An open area 63 is provided to the rear of the connecting portion 60, that is, upwardly and to the rear of the platen 24. The open area 63 consists of a first open area 63*a* for the insertion of a sheet of printing paper, located upwardly in the rear of the platen 24, and a second open area 63*b* for the insertion of a continuous length of printing paper, located directly to the rear of the platen 24 in the lateral direction. The front connecting portion 61 is placed between the forward side wall of the sub-frame 10 and the rear edge of the cover 57. The transparent subcover plate 62 made of plastic resin material and covering the ribbon cassette 55 and part of the platen 24 is detachably mounted between the side cover 58 and 59 of the rear cover 65.

When the printer arranged in the above described manner is put into operation, the pressing rollers 41 are in the first place detached from the platen 24, resisting the urging force of the springs 42 as shown in FIG. 3. From the open area 63*a* located upwardly at the rear of the platen 24, a sheet of printing paper is inserted manually in the direction X shown in FIG. 3 between the platen 24 and the pressing rollers 41. The platen 24 is rotated by means of the knob 28. The sheet of printing paper is transferred by virtue of the cooperative movement of the platen 24, the pressing rollers 41 and the guide rollers 65. A leading edge of the sheet of paper then passes between the roller 48 (refer to FIG. 2) and the platen 24 and is wound around the platen 24, being pressed thereagainst by the paper bail roller 38.

When, in this state, the driving pulley 50 is rotated by the carriage driving motor (not shown), the belt 53 is moved round in the clockwise direction as viewed in FIG. 2, in accompaniment with the movement of the carriage 44 and the printing head 47, which is parallel to the platen 24. During the course of this movement, the printing head 47 works and prints the characters on the sheet of printing paper by the medium of the ink ribbon 54 where it is exposed out of the ribbon cassette 55.

After the completion of the printing action for each line, the driving motor 30 drivingly turns by a given angle in the normal direction and, by the medium of the gears 31 and 33 and the driving gear 27, rotates the platen 24 in the clockwise direction as viewed in FIG. 3. Thus, the sheet of printing paper is upwardly transferred by an amount corresponding to one line.

In this embodiment, as the open areas are provided upwardly and laterally at the rear of the platen 24, various types of printing paper such as single sheets of, or a continuous length of printing paper and post cards, etc. can be easily inserted and placed in position, from the upper side or laterally to the rear of the platen 24. That is, when a post card feeder 134 (refer to FIG. 7) or a continuous-paper feeder 219 (refer to FIG. 10) are connected to the rear portion of the main frame 1, the portion of each feeder can be approximated to the platen 24. A post card or continuous printing paper from each of the feeders 134 and 219 is inserted into the open area 63 in the direction Y shown in FIG. 3, and then introduced along the guide member 34 into the area between the guide rollers 65 and the platen 24. Afterwards, each printing paper is wound around the platen 24 by the rotational operation thereof. In this case, the curvature of a post card can be more restrained than in the case of the conventional art An auto cut sheet feeder (not shown) for continuously feeding sheets of printing paper is placed above the platen 24. Sheets of paper from the auto cut sheet feeder are continuously fed in the direction X shown in FIG. 3, in a manner similar to the manual operation described above.

As is apparent in the above description, the mounting positions of various feeders for printing paper are less restricted, because the platen 24 is positioned to the rear of the frame 1 with the printer according to the present invention.

Second Embodiment

Next, the second embodiment embodying the present invention is described with reference to FIGS. 7 to 9.

Figures 7, 9:
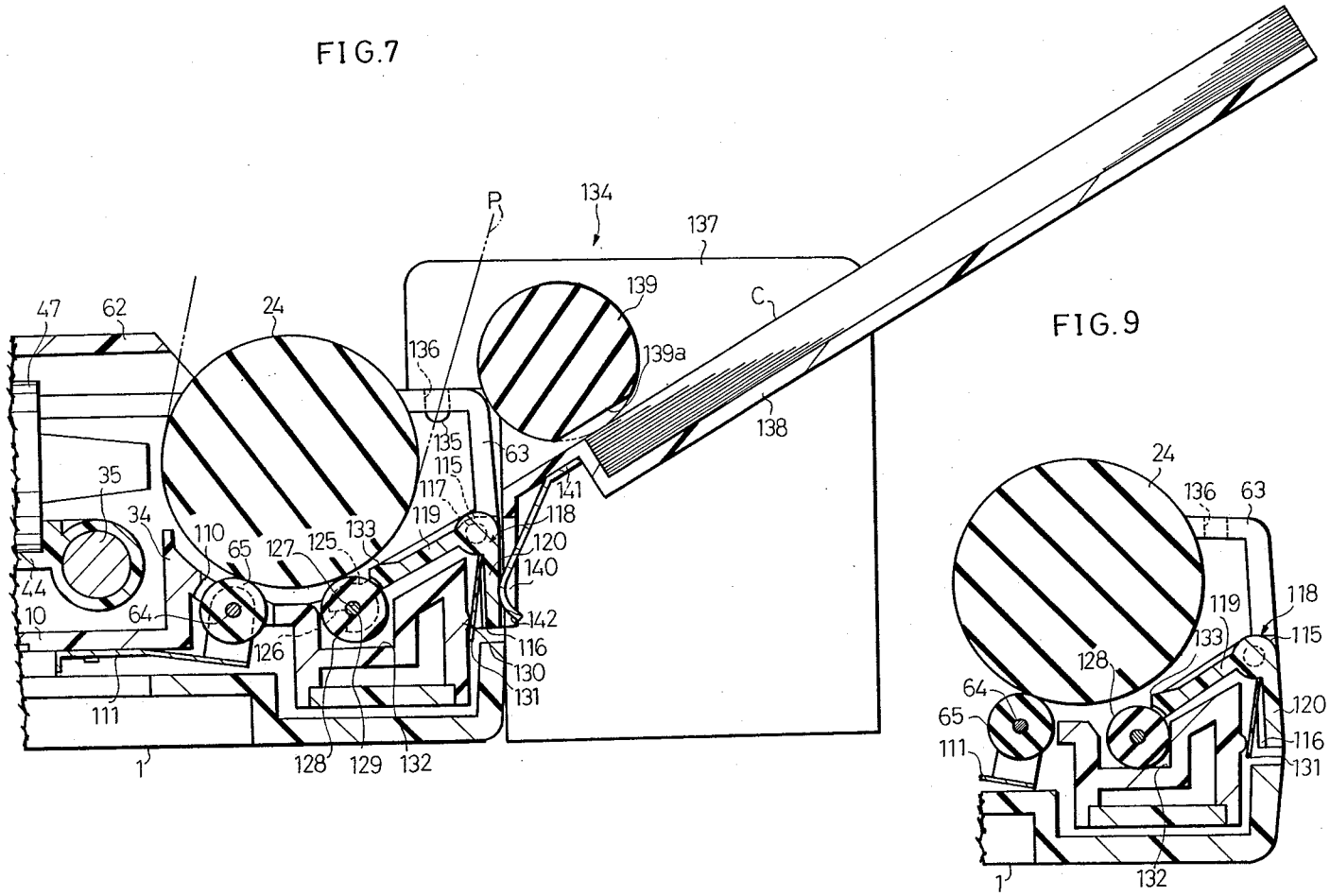
FIGS. 7 to 9 show a second embodiment of the present invention.
Figure 8:
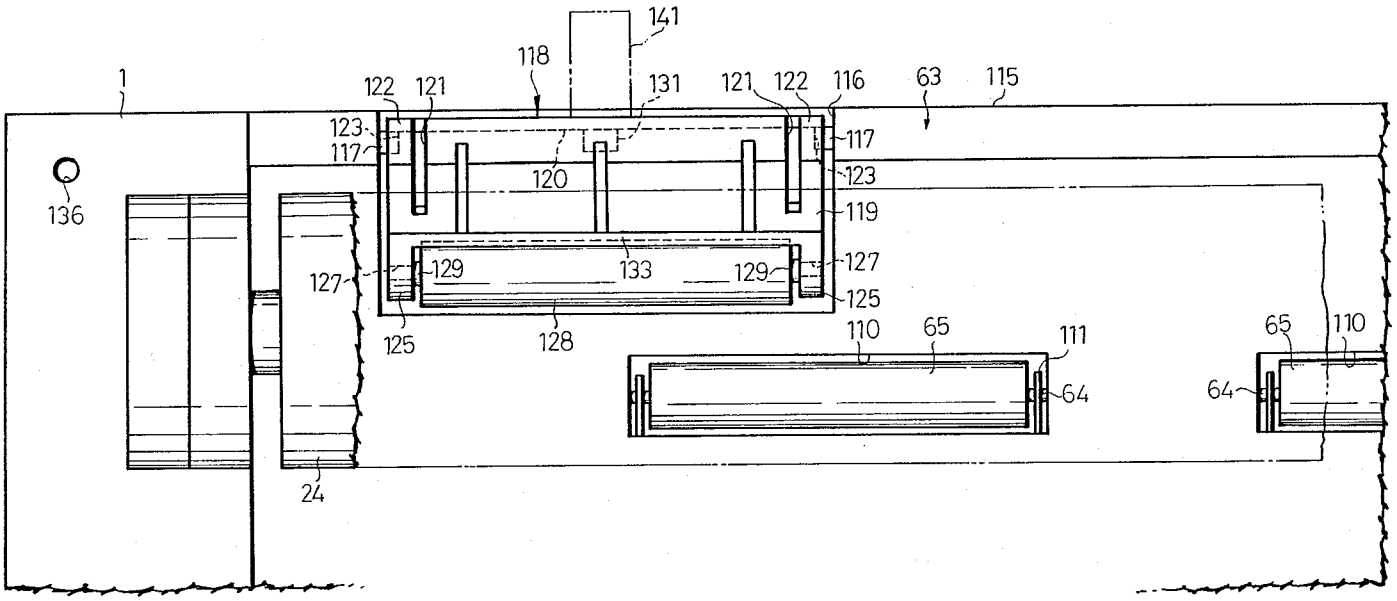

As shown in FIGS. 7 and 8, the platen 24 is rotatably supported in the rear portion of the printer frame 1. The open area 63 for insertion of printing paper is formed at the rear of the platen 24. A plurality of elongated apertures 110 are disposed along the platen 24, in the guide member 34 formed on the sub-frame 10. The elongated apertures 110 are located more forwardly than the openings 34*a* of the first embodiment. In the positions corresponding to each of the elongated apertures 110, mounting plates 111 consisting of leaf spring are attached to the under surface of the sub-frame 10. The supporting shaft 64 having the guide rollers 65 is supported by the mounting plates 111.

A cut portion 116 is formed in a portion of the rear side wall 115 of the frame 1 located under the open area 63 for the insertion of printing paper. A pair of projecting supporting shafts 117 on which a roller support member 118 is swingably mounted and which are parallel with the platen axis are provided at the upper end of the cut portion 116. The roller support member 118 is composed of a supporting plate portion 119 downwardly projecting toward the underside of the platen 24, and an engaging plate portion 120 exposed to the outside of the frame 1 through the cut portion 116 is made of plastic resin being formed in the general shape of 'V'. The supporting plate portion 119, which has the form of a plate and extends along the platen 24, is provided with slits 121 which extend along the left and right sides of the supporting plate portion 119 except for the forward end portion thereof, thereby integrally forming a pair of left and right resilient mounting portions 122 with the supporting plate portion 119. A recess 123 into which the supporting shaft 117 is inserted is formed on the outer side of the rear end of the resilient mounting portion 122, that is, on a side portion corresponding to the top of the V-shaped roller support member 118. The roller support member 118 can be detached from the frame 1 by slightly curving the resilient mounting portion 122.

Supporting projections 125 are integrally formed on the left and right sides of the forward end of the supporting plate portion 119. The supporting projection 125 is provided with a shaft support hole 127 communicating with the outer circumference thereof, through a V-shaped slit 126. A paper feed roller 128 is rotatably and detachably supported in the shaft support holes 127 at the opposed end projections of the shaft 129. A resilient urging projection 131 downwardly projecting and spacing from the engaging plate portion 120 is integrally formed on the inner side portion of the connection between the supporting plate portion 119 and the engaging plate portion 120. The lower end of the urging projection 131 contacts a protrusion 130 provided on the rear side of the sub-frame 10. By the action of this urging projection 131, the paper feed roller 128 is constantly urged as one body united with the roller support member 118 toward the inoperative position (the counterclockwise direction as viewed in FIG. 1) where the paper feed roller is detached from the platen 24. Accordingly, in its rest condition, as shown in FIG. 9, the paper feeder roller 128 is supported on the inner surface of a receiving channel 132 of the guide member 34, thus being spaced a given distance apart from the platen 24. In this state, the outside surface of the engaging plate portion 120 is substantially flush with the out side surface of the rear side wall 115 of the printer frame 1. Further, a paper guide protrusion 133 is formed to project from the forward edge of the supporting plate portion 119, which is adjacent to the roller 128.

As shown in FIG. 7, a post card feeder 134 is connected to the rear side of the printer frame 1, in a position corresponding to the paper feed roller 128. The post card feeder 134 has a pair of positioning projections 135 downwardly projecting from the left and right sides of its forward end portion The post card feeder 134 is positioned and held on the printer frame 1 by engagement between the positioning projections 135 and a pair of left and right intrusion holes 136 formed in the upper rear end portion of the printer frame 1. A mounting tray 138 is slantingly set between left and right side plates 137 of the post card feeder 134, which corresponds to the breadth of the printer frame 1. On the mounting tray 138, a plurality of stacked post cards C is supported and upwardly urged by springs (not shown). Above the lower end portion of the mounting tray 138 is supported a feed out roller 139 having a cut portion **139*a* and being detachable and rotatingly drivable. When the post card feeder is held in position on the printer frame 1, a space between the mounting tray 138 and the roller 139 faces the open area 63 of the printer frame 1, so that the upper-most post card on the mounting tray 138 is positioned in the rear prolonged plane of the guide member 34 of the printer. As the feed out roller 139 rotates clockwisely, the uppermost post cards C laid on the mounting tray 138 are fed, one after another, to the place between the platen 24 and the paper feed roller 128**.

A holding plate 141 formed by a resilient plate is engagingly attached to the underside of the forward end portion of the mounting tray 138. A curved end portion 142 of the holding plate 141 projects through a slit 140 toward the printer frame 1. When the post card feeder 134 is connected to the printer frame 1, the curved portion 142 of the holding plate 141 is brought into contact with the engaging plate portion 120 of the roller support member 118. By this means, the roller support member 118 is swung in the clockwise direction, against the urging force of the urging projection 131. Accordingly, the paper feed roller 128 is placed and resiliently held in the operative position where it can pressingly contact the platen 24.

When the printer constructed in the above described manner is operated to print characters on the post card C, the post card feeder 134 is first of all connected to the rear side of the printer frame 1, as shown in FIG. 7. At the same time, the holding plate 141 of the feeder 134 engages with the engaging plate portion 120 of the roller support member 118. The roller support member 118 is placed in the operative position. The paper feed roller 128 is, then, pressed against the platen 24, with relatively strong force, by the resiliency of holding plate 141. In this state, the feed out roller 139 of the post card feeder 134 is rotated. The post card C uppermost laid on the mounting tray 138 is fed through the open area 63 for supplying printing paper, then inserted into the place between the platen 24 and the paper feed roller 128. As the platen 24 rotates, the post card C is fed to the printing position facing the printing head 47, by virtue of the cooperation of the platen 24, the paper roller 128 and the guide roller 65. In this printing position, the printing head prints characters on the post card C. In this case, it is possible for a post card C made of thick paper having a strong force of restitution to be safely fed without any slippage, because the paper feed roller 128 pressingly contacts the platen 24 in addition to the guide roller 65.

In the case of printing characters on a sheet of ordinary, thinner printing paper P, the printer can be fed with sheets of printing paper from the space between the roller 139 and the platen 24, that is, from the upper side of the open area 63, but ordinarily, the post card feeder 134 is detached from the frame 1, at the outset. Then, the engagement of the holding plate 141 and the roller support member 118 is released. The roller support member 118 is placed in the inoperative position shown in FIG. 9, under the influence of its own weight and the urging force of the urging projection 131. As a result, the paper feed roller 128 is detached from the platen 24. The sheet of printing paper P is inserted from the upper side of the open area 63. The sheet of printing paper P is transferred to the printing position by virtue of the cooperation of the platen 24 and the guide rollers 65, and printing is thus performed. At this moment, the paper feed roller 128 is not pressed against the platen 24, so that the sheet of printing paper p is subjected to a even force which is evenly applied over the whole breadth thereof by each of the guide rollers 65. Accordingly, the sheet of printing paper P is accurately fed in the direction orthogonal to the printing line.

Thus the printer arranged in accordance with the present invention allows the paper feed roller 128 to be placed in the operative position where it engages with the platen 24 when the post card feeder 134 is mounted, at other times, to be placed in the inoperative position where it is released from the platen 24 when the post card feeder 134 is dismounted. In this way, a sheet of thick printing paper such as a post card, etc., as well as a sheet of normal printing paper which is not so thick, can be fed safely and surely.

Third Embodiment

Next, the third embodiment embodying the present invention is described in reference with FIGS. 10 to 18.

Figure 10:
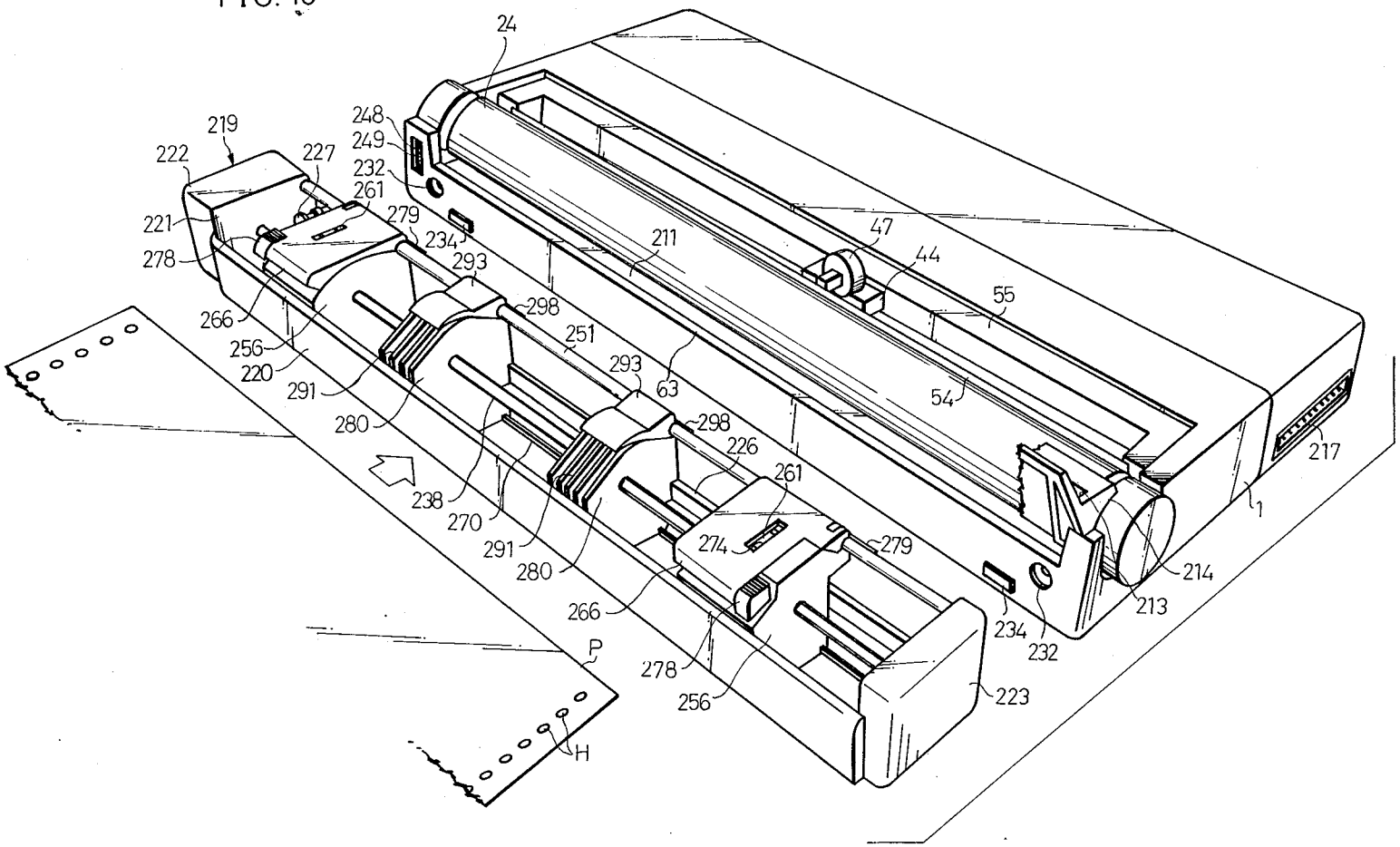
FIGS. 10 to 18 show a third embodiment of the present invention.
Figure 11:
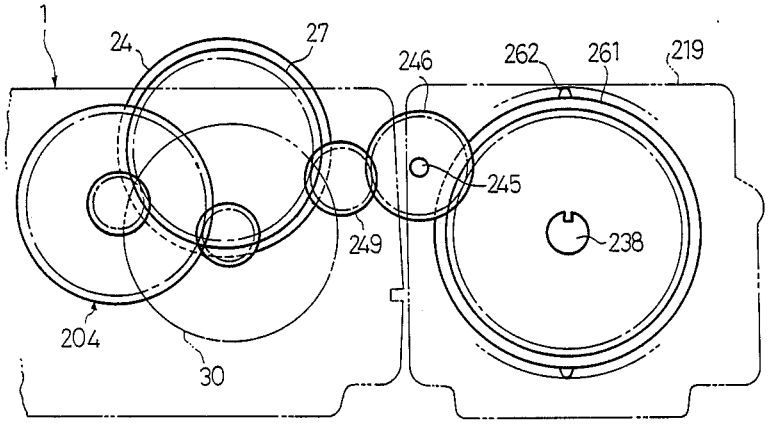
Figure 13:
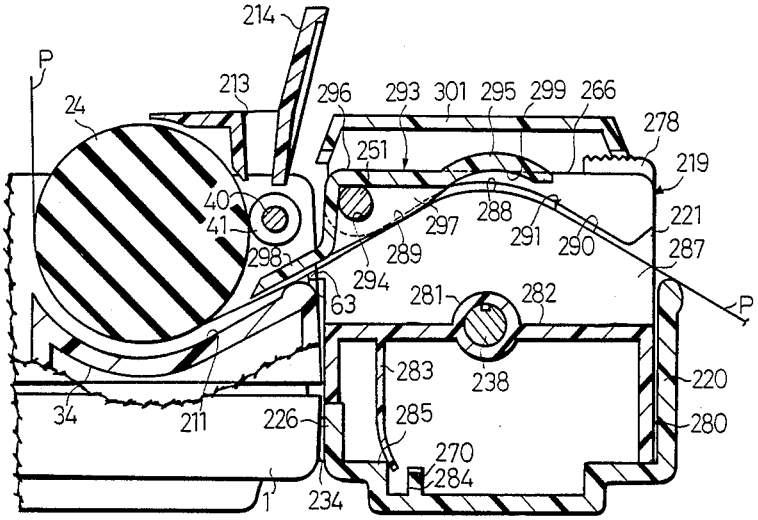

As shown in FIGS. 10 and 11, the platen 24 which is circular in section is rotatably supported at the rear portion of the main frame 1. As described above, the driving gear 27 connected to the driving motor 30 by the medium of a group of platen drive gears 204 is fixed to one end of the platen 24. As shown in FIGS. 10 and 13, the guide member 34 is provided with a concave arc surface 211 which is concentric with the platen 24. The open area 63 for insertion of printing paper is formed with its length equal to the platen 24, above the rear end of the concave arc surface 211, that is, laterally at the rear of the platen 24.

An insertion guide member 214 provided with an inlet opening 213 extending along the platen 24 is detachably mounted, above the open area 63, on the rear end portion of the frame 1. The plurality of pressing rollers 41 for pressing a sheet of printing paper, which is inserted in underside of the insertion guide member 214, against the platen 24 are rotatably disposed (omitted in FIG. 10). A connector 217 for connecting the printer to the host computer is provided on the outside of the forward end portion of the frame 1. A connector (not shown) for connecting the power supply is provided on another side of the frame 1 opposing the position of the connector 217.

Figure 12:
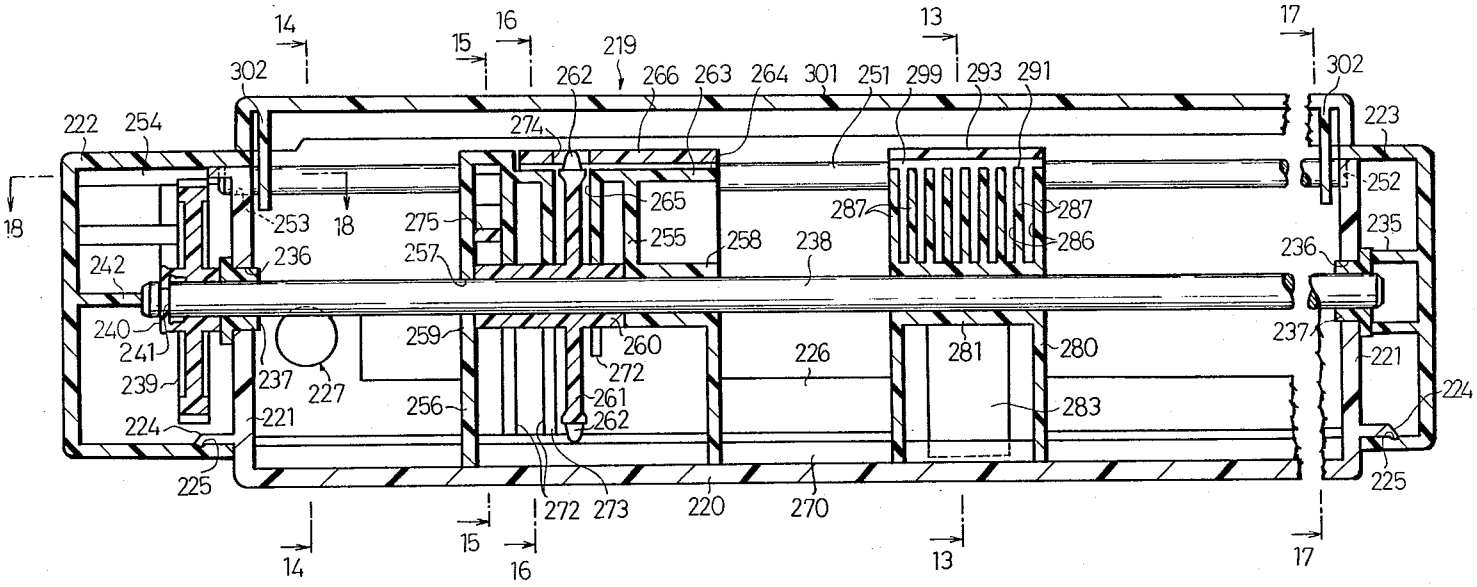
Figure 14:
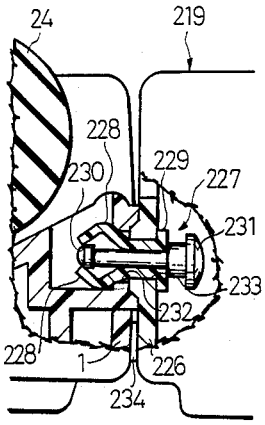

As shown in FIG. 10, a continuous-paper feeder 219 for supplying the open area 63 with a continuous printing paper P is placed at the rear of the printer. A frame 220 of the continuous-paper feeder 219 is formed of plastic resin material, into an elongated, bottomed box having a length equal to the printer. As shown in FIG. 12, side covers 222 and 223 having the shape of a square cap are detachably attached to the outsides of left and right side walls 221 of the frame 220, by means of the mating engagement between an engaging projection 224 and an engaging recess 225. A front wall plate 226 of the frame 220 is formed such that it is positioned under the level of the lower end of the open space 63 (refer to FIG. 13). In the left and right end portions of the front wall plate 226, connecting members 227 for detachably connecting the continuous-paper feeder 219 to the printer frame 1 are provided, as shown in FIG. 14. This connecting member 227 is composed of a connection tube 229 and a handling knob 231. The connecting tube 229 has a plurality of resilient projections 228 and is mounted in a through hole 233 which is formed in the front wall plate 226. The handling knob 231 is inserted in the connecting tube 229 so as to slidably penetrate therethrough, and has a engaging tip 230 which engages with the resilient projections 228, acting from the inside thereof. When the handling knobs 231 are inwardly pulled so as to contract the top end portions of the connecting tubes 229 in their diameters, the connecting tubes 229 are respectively inserted into connecting holes 232 which are formed in left and right sides of the rear surface of the printer frame 1. Then, the handling knobs 231 are pushed and each resilient projection 228 is outwardly curved, by the medium of the engaging tip 230. Thus, the continuous-paper feeder 219 is connected to the rear side of the printer frame 1. As shown in FIGS. 10, 13 and 14, cushion members 234 made of rubber, etc. are provided on the rear sides of the left and right end portions of the main frame 1. These cushion members 234 are composed in a manner such as in the case of the aforementioned cushion member 15 of the first embodiment.

As shown in FIG. 12, each bearing hole 236 is approximately centrally formed on the left and right side walls 221 of the frame 220 of the continuous-paper feeder 219. A slidable guide shaft 236 having a groove is rotatably supported by the bearing holes 236, by the medium of bearings 237. A driven gear 239 is attached, mutually non-rotatably, to the left end (according to FIG. 12) of the slidable guide shaft 238. The right side of the driven gear 239 contacts the outer side surface of the left bearing 237. A plurality of stopping protrusions 240 protruding on the left side surface of the driven gear 239 are engagingly detained by stopping grooves 241 formed by cutting on the left end portion of the slidable guide shaft 238. By this arrangement, the driven gear 239 is not slidable on the slidable guide shaft 238. A non-slip-off projection 242 is formed on the inner surface of the left side cover 222. The top end of the non-slip-off projection 242 contacts the left end surface of the slidable guide shaft 238 so as to prevent this shaft from slipping off. According to FIG. 12, the right bearing 237 is pressingly held by an annular rib 235 projecting from the inner surface of the right side cover 223.

Figure 18:
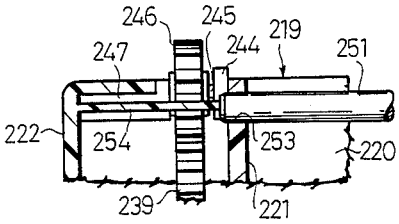

As shown in FIG. 18, a protruding portion 244 is outwardly and integrally formed on an upper portion of the front edge of the left side wall 221 of the frame 220. A supporting shaft 245 is fixed to the protruding portion 244. An intermediate gear 246 adapted for engaging with the driven gear 239 is rotatably supported by the supporting shaft 245. A rib portion 247 of the left side cover 222 holds and prevents the intermediate gear 246 from slipping off. As shown in FIG. 11, part of the intermediate gear 246 protrudes beyond the front surface of the frame 220. When the continuous-paper feeder 219 is connected to the printer, the intermediate gear 246 engages with a connecting gear 249 in the group of platen drive gears 204, through a window 248 formed in the rear wall of the frame 1 (refer to FIG. 10). The rotation of the driving motor 30 is transmitted to the driven gear 239, by the medium of the driving gear 27, connecting gear 249 and intermediate gear 246, and the slidable guide shaft 238 is rotated in the counterclockwise direction as viewed in FIG. 11.

As shown in FIGS. 10 and 12, a support shaft 251 extending parallel with the slidable guide shaft 238 is provided in the forward upper hand portion of the frame 220. The right end (as viewed in FIG. 12) of the support shaft 251 is inserted into and supported by a recess hole 252 formed on the inner side of the right side wall 221, while the left end penetrates a bearing hole 253 formed in the left side wall 221. As shown in FIG. 18, the left end surface of the support shaft 251 contacts the top end surface of a holding portion 254 projecting from the inner surface of the left side cover 222 so that the support shaft 251 is prevented from slipping off.

Figure 16:
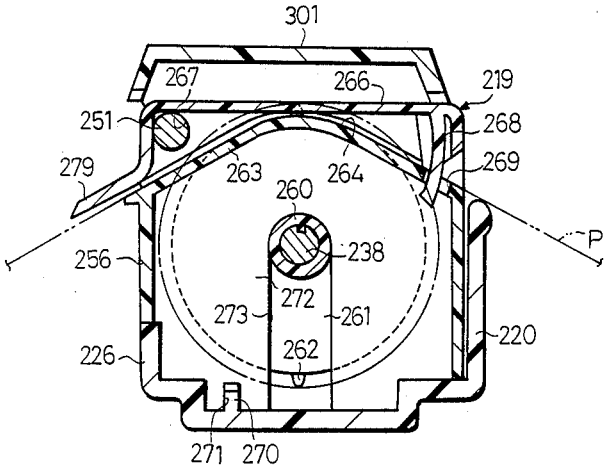

As shown in FIGS. 10, 12 and 16, a pair of left and right feed guide blocks 256 in the form of a box and made by plastic resin material are disposed in the frame 220. Each feed guide block 256 is slidable on the slidable guide shaft 238, by insertion of the shaft through hole 257 formed in a first wall 259 of the feed guide block 256 a insertion through pipe 258 formed on in a second side wall 255 on the opposite side of the feed guide block 256. In each feed guide block 256, a sprocket wheel 261 is penetrated and secured to the slidable guide shaft 238, being non-rotatable and slidable by means of a boss sleeve portion 260 of the sprocket wheel 261. The opposite end surfaces of the boss sleeve portion 260 contact the inner surfaces of the first side wall 259 and the insertion through pipe 258. Thus, the sprocket wheel 261 and the feed guide block 256 unitedly slide on the slidable guide shaft 238. On the outer circumferences of each sprocket wheel 261 is formed a plurality of projecting pins 262 adapted for engaging with side perforations H of the continuous printing paper P (refer to FIG. 10).

An upper wall plate 263 is integrally formed on the upper end of each feed guide block 256. The upper surface of the upper wall plate 263 is formed into a paper feeding surface 264 which has a shape of a gentle wave crest and generally corresponds to the outer circumference of the sprocket wheel 261, and a slit 265 through which the pins 262 of the sprocket wheel 261 upwardly protrude is formed in the upper wall plate 263. A suppressing member 266 for covering over each paper feeding surface 264 is swingably supported by the support shaft 251, at a shaft insertion through hole 267 formed in the front end portion of the suppressing member 266. The under surface of the suppressing member 266 is formed with a concave curve so as to facing the paper feeding surface 264 at some distance, and an adaptation hole 274 to which the pins 262 of the sprocket wheel 261 is adapted is formed in the middle of the suppressing member 266.

A catch extension 268 adaptable for engaging with a catch hole 269 bored in the upper wall plate 263 is integrally formed on the rear under side surface of the suppressing member 266. When the suppressing member 266 is held in the closed position by the engagement of the catch extension 268 and the catch hole 269, a lower edge of the suppressing member 266 acts to maintain the engagement between the pins 262 and the side perforations H of the continuous printing paper P. When the suppressing member 266 is open, being pivotally supported by the support shaft 251, the continuous printing paper p is set to or detached from the feed guide block 256. The continuous printing paper P is transferred along the paper feeding surface 264 toward the open area 63 of the printer frame 1 by means of the engagement between the pins 262 and the side perforations H, on condition that, when the suppressing member 266 is closed, the sprocket wheels 261 and the slidable guide shaft 238 unitedly rotate, accompanying the rotation of the motor 30.

A cut groove 271 (FIG. 16) which is matingly adapted to a rail 270 standing on the bottom surface of the frame 220 is formed on the lower end of each feed guide block 256. Inside the feed guide block 256, a plurality of reinforcement plates 272 is integrally formed and provided with assembling guide channels 273 in the form of downwardly opened cut portions. By means of adaptation of the boss sleeve portion 260 to these channels 273, the boss sleeve portion 260 of the sprocket wheel 261 is led to a position where it faces the insertion through hole 257 and the insertion through pipe 258.

Figure 15:
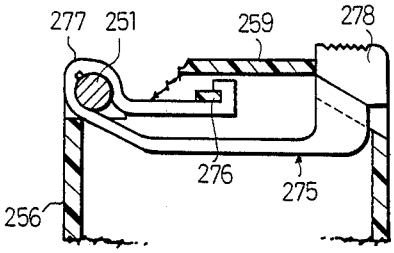

On one hand, as shown in FIG. 15, a resilient and flexible positioning member 275 in the form of a double-bent band made of plastic resin material is placed between the one sided wall 259 of the feed guide block 256 and the adjacent reinforcement plate 272. The upper side end portion of the positioning member 275 is engagingly fixed to a stop portion 276 protecting from the inner surface of the one-sided wall 259. The middle bent portion of the positioning member 275 is formed with a encircling holder portion 277 for encircling and resiliently holding the support shaft 251. A handling portion 278 is integrally formed on the other end portion of the positioning member 275 which is upwardly exposed in the rear portion of the feed guide block 256. Thus, normally, the encircling holder portion 277 holds the support shaft 251 by virtue of elasticity of the positioning member 275, so that the feed guide block 256 is non-slidably held. When the handling portion 278 is pressed and lowered, the encircling holder portion 277 is opened against the elasticity of the positioning member 275, and the support shaft 251 is released. Then, the feed guide block 256 is allowed to slidingly move. In this way, the positions of both feed guide blocks 256 can be adjusted so as to correspond to the breadth of the continuous printing paper P.

As shown in FIGS. 10, 12 and 13, a pair of left and right lower guide blocks 280 in the form of a box made of plastic resin material are disposed between the feed guide blocks 256, in the frame 220. The lower guide block 280 is slidable at a central cylindrical portion 281 thereof, on the slidable guide shaft 238. A horizontal plate 282 is formed in the middle portion of each lower guide block 280, as defined in the vertical direction. A damping extension 283 which resiliently contacts, at its lower end, a stepping edge 285 formed at the bottom of the frame 220 is integrally formed on the forward underside portion of the horizontal plate 282. The lower guide block 280 is held in an optional slidable position by the frictional force due to the elasticity of the damping extension 283. A cut groove 284 matingly adapted to the rail 270 is formed at the lower ends of left and right side walls of the lower guide block 280.

In the upper half portion of each lower guide block 280, a plurality of vertical plates 287 is integrally formed, by alternately interposing gaps 286 therebetween which are opened to the upper, front and rear sides of this portion. The upper surface of the lower guide block 280 defined by the upper end surfaces of the vertical plates 287 is formed as paper support surfaces 291 which have shapes of gentle wave crests and consist of: arc surfaces 288 having shapes generally equal to the outer circumference of the sprocket wheel 261; front slant surfaces 289 descendingly extending from these arc surfaces 288 in the direction generally corresponding to the rear production of the concave arc surface 211 of the paper guide member 34 provided in the printer; and rear slant surfaces 290 in an axially symmetrical relation with these front slant surfaces 289. The front ends of the front slant surfaces 289 slightly protrude so as to intrude into the open area 63. The paper feeding surface 264 of the feed guide block 256 is formed such that the its height and shape are equal to those of the paper support surface 291. When the sprocket wheel 261 rotates and the continuous printing paper p is supplied, the underside of the continuous printing paper P located between the sprocket wheels 261 is upwardly supported by the paper support surfaces 291 of the lower guide blocks 280. Thus, any sinkage of the continuous printing paper due to the weight of itself can be prevented.

On one hand, as shown in FIGS. 10, 12 and 13, a pair of left and right upper guide blocks 293 are slidably and swingably supported at centrally formed shaft insertion through holes 294 thereof, between the feed guide block 256, by the support shaft 251, so as to downwardly facing the lower guide block 280 through the continuous printing paper P. The upper guide block 293 is made of plastic resin and thus provided for the purpose of pressing down and guiding the continuous printing paper P located between the sprocket wheels 261. As shown in FIG. 13, each upper guide block 293 is provided with a arc-shaped rear end plate portion 295 downwardly facing the arc surface 288 of paper support surface 291 in the lower guide block 280, and an intermediate plate portion 296 having a shape of 'L' in section. Each upper guide block 293 is further provided with side plate portion 297 forming left and right sides of the intermediate plate portion 296. The shaft insertion through holes 294 are formed in the side plate portions 297. The under surface of the side plate portion 297 descendingly extend along the front slant surface 289 of the lower guide block 280. Each upper guide block 293 comprises a front end plate portion 298 which is similar to a louver board and extends forwardly and downwardly in a plane shared with the under surface of the side plate portion 297, continuously forming therewith. Similarly, a like front end plate portion 279 is formed at the front end of the suppressing member 266 of the feed guide block 256, as shown in FIG. 16.

When the upper guide block 293 is slid on the support shaft 251 and positioned on the upper side of the lower guide block 280, the under surface of the side plate portion 297 contacts the front slant surface 289 of the lower guide block 280 by virtue of swinging movement of the upper guide block 293 in the counterclockwise direction viewed in FIG. 13. Simultaneously, a given gap 299 for insertion of the continuous printing paper P is formed between the rear end plate portion 295 and the arc surface 288 of the lower guide block 280. When, in this state, the continuous-paper feeder 219 is connected to the printer by the connecting members 227, the front end plate portion 298 of the upper guide block 293 is led through the open area 63 of the printer frame 1 and is positioned so as to face the concave arc surface 211 of the guide member 34, being approximately parallel therewith.

Figure 17:
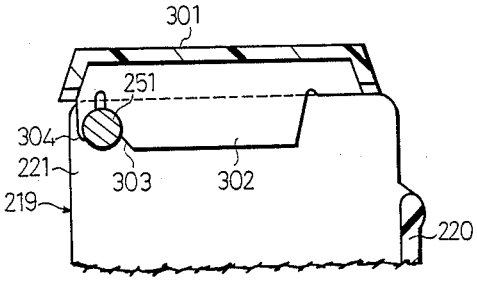

As shown in FIGS. 12, 13, 16 and 17, the whole upper surface of continuous-paper feeder 219 is covered by a cover 301 made of transparent plastic resin material. As shown in FIG. 17, a recess 303 and an encircling holder projection 304 are provided on the forward portion of a vertical extension 302 which is integrally formed in each of left and right end portion of the cover 301. The support shaft 251 is fitted to the recess 303 and resiliently held by the encircling holder portion 304. The cover 301 is fitted to the support shaft 251 by means of the recess 303 and the encircling holder portion 304, thus swingably, in opening or shutting operation, and detachably held.

When the printer constructed as in the above as the third embodiment is used in printing characters on the continuous length of printing paper P, the continuous-paper feeder 219 is placed to the rear of the printer, in the first place, and these two are connected by the connecting members 227. The intermediate gear 246 provided in the continuous-paper feeder 219 engages with the connecting gear 249 in the group of platen drive gears 204. The front end plate portions 298 and 279 of the upper guide block 293 and the suppressing member 266 are led through the open area 63 and are positioned so as to face the concave arc surface 211. Protruding portions of the lower guide block 280 and the feed guide block 256 is inserted in the open area 63.

Next, the handing portion 278 of each positioning member 275 is operated by applying pressure thereon and the feed guide blocks are slid and properly positioned in the lateral direction so that the sprocket wheels corresponds to the breadth of the continuous printing paper P. The lower guide blocks 280 and the upper guide blocks 293 are properly positioned between the sprocket wheels 261. The upper and lower guide blocks 280 and 293 are not necessarily placed in the overlapped position as shown in the figures. Then, the suppressing member 266 of the feed guide block 256 is released, and, after the side perforations H of the front end portion of the continuous length of printing paper p is engagingly fixed to the pins 262 of the sprocket wheels, the suppressing member 266 is closed.

In this state, the motor 30 is started, and the platen is rotated by the medium of the group of platen drive gears 204 and the driving gear 27. Simultaneously, the slidable guide shaft 238 and the sprocket wheels 261 are unitedly driven by the medium of the connecting gear 249, the medium gear 246 and the driven gear 239, and, thereby, the continuous printing paper P is transferred on the paper feeding surface 264 of the feed guide block 256. In this operation, the continuous printing paper p is guided and transferred between the sprocket wheels 261 by being interposed between each upper guide block 293 and each lower guide block 280, so that the medium portion of the continuous printing paper P does not sink or floats even if it has wide breadth. As the sprocket wheel 261 rotates, the continuous printing paper P is transferred along the paper feeding surface 264 of the feed guide block 256 and the paper support surface 291 of the lower guide block 280, toward the open area 63 of the printer frame 1. The front edge of the continuous printing paper P is substantially linear when introduced into the open area 63. Thereafter, the linearity of the front edge of the continuous printing paper is maintained, and the printing paper is smoothly set around the outer circumference of the platen 24, because the front end plate portions 298 and 279 of the upper guide block 293 and the suppressing member 266 is opposed to the concave arc surface 211 of the printer, being substantially parallel therewith.

The continuous printing paper p is thus set on the platen 24, and the printing head 47 and the carriage 44 are respectively driven so as to print given characters on the continuous printing paper P. The paper feeding surface 264 and the suppressing member 266 of the feed guide block 256 have functions which are respectively equal to those of the paper support surface 291 of the lower guide block 280 and the upper guide block 293.

When this printer is used in printing on sheets of printing paper, a sheet of printing paper is supplied through the inlet opening 213 of the insertion guide member 214 and is transferred to the printing position by virtue of cooperation of the platen 24 and the pressing rollers 41.

When the continuous-paper feeder 219 having the above described constitution is assembled, the sprocket wheels 261 are accommodated through the assembling guide channel 273, in the feed guide block 256, as shown in FIG. 12. The driven gear 239 is engagingly fixed to one end of the slidable guide shaft 238. The another end of the same is inserted into one of the sides walls 221, the feed guide blocks 256 and the lower guide blocks 280, and is supported at the another side wall 221, after the feed guide block 256 and the lower guide block 280 are mounted on the bottom surface of the frame 220. The support shaft 251 is spanned between the side walls 221, through the suppressing members 266 and the upper guide blocks 293. In this state, side cover members 222 and 223 are respectively attached to the side walls 221. The slidable guide shaft 238, the medium gear 246 and the support shaft 251 are laterally secured by the non-slip-off projection 242, the rib portion 247 and the holding portion 254 formed in the side cover member 222. Consequently, the continuous-paper feeder 219 can be readily mounted without using parts such as screws and different types of tools.

The printer as the third embodiment of the present invention is provided with the connector 217 for connection to a host computer and another connector for connection to a power source, which are located on the left and right sides of the front portion of the printer frame 1. These apparatuses can be readily connected each other without any obstruction by the continuous-paper feeder 219 and the continuous printing paper P.

In short, in the printing operation of the printer according to the present invention, a continuous length of printing paper is prevented from sinking and floating between the sprocket wheels by virtue of the lower and upper guide blocks. The printing paper, even if it has wide breadth, can be readily set around the platen, as the printing paper is guided and transferred through the open area of the printer frame for insertion of printing paper to the concave arc surface of the guide member by virtue of the front end portion of the upper guide block.

What is claimed is;

1. In a feeder for feeding continuous printing paper, having a plurality of perforations formed along both side edges thereof, to a printer, said feeder comprising:

a frame;

a rotating shaft mounted in said frame;

a pair of guide blocks provided in said frame, said guide blocks being slidable in the axial direction of said rotating shaft; and a respective sprocket wheel mounted in each said guide block with part of each said sprocket wheel exposed to the upper sides of the respective said guide block, said sprocket wheels being unitedly rotatably with said rotating shaft and slidable in the axial direction thereof, the improvement wherein:

each of said guide blocks is in the form of a box having an opened bottom toward the bottom surface of said frame and being provided with an upper wall plate having a partially curved upper surface extending generally along part of the outer circumference of the respective said sprocket wheel, each guide block having first and second side wall plates with holes through which said rotating shaft extends, said first and second side wall plates being on opposite sides of the respective guide block along the axial direction of said rotating shaft;

each of said guide blocks is provided with a slit formed in said upper wall plate and connected with a space between said first and second side wall plates in each said guide block, said pace between said first and second side wall plates being downwardly open through said opened bottoms and having a dimension larger than a diameter of said sprocket wheel, each said sprocket wheel being positioned in said space between said side wall plates with a part of the circumference of said sprocket wheel being exposed through said slit, each of said guide blocks being provided with a reinforcement plate between said side wall plates, said reinforcement plate having a downwardly open channel axially aligned with said holes of said first and second side wall plates;

each of said sprocket wheels having a boss sleeve portion fitted to said rotating shaft and extending in the axial direction thereof, said boss sleeve portion received by an supported in said channel, the opposite ends of said boss sleeve portion respectively facing the inner sides of said first and second side wall plates of said guide block.

2. A feeder according to claim 1, further comprising:

a lower guide block mounted in said frame in a position between aid guide blocks and being slidable in the axial direction of said rotating shaft, said lower guide block having an upper surface in a form substantially along part of the upper surface of said guide block and having a side hole for penetration of said rotating shaft, said side hole being coaxially aligned with said hole of said guide block when said lower guide block is mounted on the bottom surface of said frame.

3. A feeder comprising:

a frame having a pair of side walls in which aligned bearing holes are respectively formed, a rotating shaft rotatably supported by said bearing holes and extending between said side walls;

a gear affixed to said shaft axially outwardly of one of said side walls;

a pair of sprocket wheels each having a plurality of pins engaging perforations formed along opposite side edges of a continuous printing paper, and fitted on said rotating shaft, between said side walls; and a side cover attached to said one side wall along its outer perimeter from a direction axially outwardly of said one side wall and extending axially outwardly of said frame, said side cover having means axially contacting one end of said rotating shaft so as to prevent movement of said rotating shaft in its axial direction from said one side wall toward the outside of said frame.

4. A feeder according to claim 3, wherein said side cover has a projection inside thereof and a top end of said projection contacts said one end of said shaft.

5. A feeder for feeding continuous printing paper, having a plurality of perforations formed along both side edges thereof, to a printer, said feeder comprising a frame; a rotating shaft mounted in said frame; a pair of guide blocks provided in said frame, said guide blocks being slidable in the axial direction of said rotating shaft; and a sprocket wheel mounted in each said guide block with part of each said sprocket wheel exposed to the upper sides of the respective said guide block, said sprocket wheels being unitedly rotatable with said rotating shaft and slidable in the axial direction thereof, where:

each of said guide blocks is in the form of a box having an open bottom toward the bottom surface of said frame and being provided with an upper wall plate having a partially curved upper surface extending generally along part of the outer circumference o the respective said sprocket wheel, each guide block having first and second side wall plates with holes through which said rotating shaft extends, said first and second side wall plates being on opposite sides of the respective guide block along the axial direction of said rotating shaft; each of said guide blocks is provided with a slit formed in said upper wall plate and connected with a space between said first and second side wall plates in each said guide block; said space between said first and second side wall plates being downwardly open through said opened bottoms and having a dimension larger than a diameter of said sprocket wheel; each said sprocket wheel being positioned in said space between said first and second side wall plates with a part of the circumference of said sprocket wheel being exposed through said slit; said frame having a bottom wall substantially parallel with said shaft and a pair of side walls positioned at both ends of said shaft, said shaft having both ends supported on said side walls of said frame; each said guide block being slidable with said opened bottom thereof contacting said bottom wall of said frame.

6. A feeder according to claim 5, further comprising:

a side cover attached to said one side wall of said side walls, said side cover contacting one end of said rotating shaft so as to prevent movement of said rotating shaft in its axial direction from said one side wall toward the outside of said frame.

7. A feeder according to claim 5, wherein said bottom wall of said frame has a stand-up rail and each said guide block has an engaging portion engaging with said rail.

8. A feeder according to claim 5, further comprising:

a lower guide block mounted in said frame in a position between said guide blocks and being slidable in the axial direction of said rotating shaft, said lower guide block having an upper surface in a form substantially along part of the upper surface of said guide block and having a side hole for penetration of said rotating shaft, said side hole being coaxially aligned with said hole of said guide block when said lower guide block is mounted on the bottom wall of said frame.

* * * * *